US010130145B2

(12) United States Patent
Sugiyama

(10) Patent No.: US 10,130,145 B2
(45) Date of Patent: Nov. 20, 2018

(54) FABRIC FASTENER

(71) Applicant: Miwaku Corporation, Tochigi (JP)

(72) Inventor: Rikako Sugiyama, Tochigi (JP)

(73) Assignee: Miwaku Corporation, Tochigi (JP)

( * ) Notice: Subject to any disclaimer, the term of this patent is extended or adjusted under 35 U.S.C. 154(b) by 0 days.

(21) Appl. No.: 15/566,078

(22) PCT Filed: Apr. 13, 2016

(86) PCT No.: PCT/JP2016/061888
§ 371 (c)(1),
(2) Date: Oct. 12, 2017

(87) PCT Pub. No.: WO2016/167275
PCT Pub. Date: Oct. 20, 2016

(65) Prior Publication Data

US 2018/0092436 A1 Apr. 5, 2018

(30) Foreign Application Priority Data

Apr. 14, 2015 (JP) ..... 2015-082901

(51) Int. Cl.
*A44B 6/00* (2006.01)

(52) U.S. Cl.
CPC ..... *A44B 6/00* (2013.01); *Y10T 24/1986* (2015.01)

(58) Field of Classification Search
CPC ..... A44B 6/00; A41D 24/008; A41D 24/022; Y10T 24/1986
See application file for complete search history.

(56) References Cited

U.S. PATENT DOCUMENTS 2,735,105 A * 2/1956 Traub ..... A41D 25/022 2/150
3,060,448 A * 10/1962 Mongelli ..... A41D 25/022 2/150

(Continued)

FOREIGN PATENT DOCUMENTS

EP 0855151 A1 7/1998
FR 1057191 A 3/1954

(Continued)

OTHER PUBLICATIONS

International Search Report dated Jul. 5, 2016 filed in PCT/JP2016/061888.

(Continued)

*Primary Examiner* — Robert Sandy
(74) *Attorney, Agent, or Firm* — Rankin, Hill & Clark LLP

(57) ABSTRACT

A fabric fastener provided by the invention of the present application exerts a decorative design function due to many variations created by fabric itself. In particular, the fastener can be, according to this fastener, easily handled without damaging the fabric in handling the fabric. Furthermore, the fastener exerting a high fabric looseness prevention effect even after a long-term use is provided. According to an employed configuration, the fabric fastener includes a substantially tubular body having a substantially C-shaped cross section, the substantially tubular body being provided with a slit portion (40) provided at an insertion path (10) for tucking and fixing inserted fabric (100). The substantially tubular body is provided with opening portions (20) and a drawing hole (30). The opening portions (20) have substantially V-shaped or U-shaped constrictions provided on an upper and lower sides in order to guide a finger. The drawing hole (30) includes at least one drawing hole formed such that the fabric (100) inserted through the opening portion (20) is (Continued)

drawn out in a circumferential direction with respect to an insertion direction. Rim portions of the drawing hole (30) and the opening portion (20) are rounded.

16 Claims, 6 Drawing Sheets

(56) References Cited

U.S. PATENT DOCUMENTS

| | | | | |
|---|---|---|---|---|
| 3,631,541 | A | 1/1972 | Williams | |
| 5,920,907 | A * | 7/1999 | Pierce | A41D 25/022 2/148 |
| 2003/0177564 | A1 * | 9/2003 | Kear | A41D 25/008 2/152.1 |
| 2005/0076417 | A1 * | 4/2005 | Sampy | A41D 25/022 2/153 |
| 2006/0144087 | A1 | 7/2006 | Wilson | |
| 2007/0151000 | A1 | 7/2007 | Gates | |

FOREIGN PATENT DOCUMENTS

| | | | |
|---|---|---|---|
| FR | 2656508 | A1 | 7/1991 |
| JP | 5156103 | | 5/1976 |
| JP | 3018784 | U | 11/1995 |
| JP | 07292509 | | 11/1995 |
| JP | 3053118 | U | 10/1998 |
| JP | 2000014414 | A2 | 1/2000 |
| JP | 3126281 | | 10/2006 |
| JP | 2010142484 | A2 | 7/2010 |

OTHER PUBLICATIONS

Extended European Search Report dated Mar. 8, 2018 for the corresponding European Patent Application No. 16780066.3.

* cited by examiner (a)

(b)

FABRIC FASTENER

TECHNICAL FIELD

The invention of the present application relates to a fastener for fabric such as a scarf, a stole, or a shawl. That is, the present invention relates to a technique for a fabric fastener, the technique allowing for easy fixing without damaging the fabric even in wearing the fabric as a piece of body decoration equipment over clothes and allowing for a creation of a wide variety of aesthetic visual shapes.

BACKGROUND ART

Typically in the field of body decoration articles, annular rubber members, clips, and the like, and those in a form of a decorative fastener have been generally used as fasteners for fastening a scarf and the like. However, many of these fasteners are formed of annular members. In the case of such an annular shape, fabric is drawn out through a hole portion. Thus, the cloth is often damaged due to a sharp bend caused by a turnback, a knot, or the like.

Moreover, these fasteners need to exert, as the functions thereof, the looseness prevention effect of holding the fastener and the fabric in position.

For these reasons, until now various techniques have been proposed for solving these problems. For example, JP-A-07-292509 describes a technique "with a combination of an elastic annular fastener 2 and a scarf body 1 woven in an annular shape or formed in an annular shape by stitching up both longitudinal ends of a band-shaped woven fabric," making the technique known to the public. This literature also describes that an objective of the technique is "to provide a scarf which does not slip down on the body, is therefore kept in a state of beautiful shape, and is very easily wearable."

Moreover, such a technique exerts the effect of preventing the scarf from slipping down on the body and of enabling even the elderly to wear a scarf easily and beautifully. The advantageous effects of the above-described technique and the invention of the present application have something in common. However, JP-A-07-292509 does not describe a decorative effect of the above-described technique in contrast to the invention of the present application. For this reason, the beautifully-wearable effect of the above-described technique is uncertain. Moreover, the end portion needs to be inserted and drawn in from the tip end because of the annular shape of the fastener. In this respect, handling is not easy.

On the other hand, the fabric fastener of the invention of the present application has a slit portion. Thus, attachment of such a fabric fastener is facilitated. Moreover, a drawing hole for exerting a decorative effect is provided. With this configuration, modification to a wide variety of designs for exerting a high aesthetic decorative effect is allowed. In this respect, the invention of the present application is significantly different.

Furthermore, Japanese Utility Model No. 3126281 describes a fastener "for providing a neckwear not only having a combination of a neckwear body and a band-shaped body such as a scarf but also producing a fresh design by such a combination." Specifically, the following idea has become a known technique by Japanese Utility Model No. 3126281. That is, in this literature, the following techniques are described: "the neckwear includes a neckwear body A having many loop portions arranged in series by sewing core threads and a small raised fabric piece attached to each loop portion; a band-shaped body B such as a scarf is inserted into each loop portion of the neckwear body A; the band-shaped body B is combined integrally with the neckwear body A in an entangled manner; and therefore, a fresh design totally different from that in the case of using each component alone is produced."

The above-mentioned idea has it in common with the present application that "creating a fresh design makes dressing up enjoyable." However, the above-mentioned idea provides a long and large neckwear in terms of the compatibility with the fixed target article to be worn. For this reason, there is a problem of too great an influence of the nature of its own unique design as shown in examples illustrated in FIGS. 4 to 8. On the other hand, the invention of the present application is significantly different in the following respect. That is, the invention of the present application provides a compact fabric fastener, and therefore, such a fabric fastener is, in the entire formational arrangement, a spot accessory almost unnoticeable from the outside. Nonetheless, the texture, pattern, and the like of the fixed target article itself are utilized in the variety of the created designs and in the created aesthetic forms.

SUMMARY OF THE INVENTION

Problems To Be Solved By The Invention

According to the fabric fastener of the invention of the present application, a decorative design function due to many variations created by fabric itself is exerted. In particular, the fastener can be easily utilized without damaging the fabric in handling the fabric. Furthermore, a high fabric looseness prevention effect even after a long-term use is exerted. With the invention of the present application, it is attempted to provide such a fastener.

Solution to the Problems

The invention of the present application provides a fastener for fastening fabric used as a piece of body decoration equipment. This fastener includes a substantially tubular body having a substantially C-shaped section. The substantially tubular body is provided with an insertion path for tucking and fixing the inserted fabric, a slit portion provided at the insertion path, opening portions, and a drawing hole. The opening portions have substantially V-shaped or U-shaped constrictions provided on the upper and lower sides. The drawing hole includes at least one hole formed such that the fabric inserted through the opening portion is drawn out in a circumferential direction with respect to the insertion direction. A rounded shape is adopted for rim portions 21 of the drawing hole and the opening portions.

Moreover, the invention of the present application may employ a configuration in which the fabric fastener is in such a shape that the drawing portion is provided at a single position on each side in the circumferential direction.

Furthermore, the invention of the present application may employ a configuration with such a shape that the drawing portion is provided at a single position on each side in the circumferential direction, and is also provided at a single position in a forward direction.

In addition, the invention of the present application can employ a configuration in which the fabric fastener is in such a shape that the drawing portion is provided at two or more positions on each side in the circumferential direction, and is also provided at a single position in the forward direction.

Moreover, the invention of the present application can employ a configuration in which the fabric fastener is in such a shape that the drawing portion is provided at two or more positions on each side in the circumferential direction.

Furthermore, the invention of the present application can employ a configuration in which the insertion path is in a shape narrowed inward from the opening portion.

Effects of the Invention

According to the fabric fastener of the invention of the present application, a decorative design function due to many variations created from fabric itself is exerted. In particular, in terms of handling, the fastener can be easily utilized without damaging the fabric in handling the fabric. Furthermore, a high fabric looseness prevention effect even after a long-term use is exerted.

DESCRIPTION OF THE EMBODIMENTS

A fabric fastener 1 of the invention of the present application has such most prominent characteristics that the fabric fastener 1 has opening portions that have substantially V-shaped or U-shaped constrictions provided on an upper and lower sides in order to guide a finger and that the fabric fastener 1 employs such a shape that the finger inserted through the opening portion can be easily guided for easy drawing of the fabric out from a drawing hole. A configuration of the invention of the present application will be described below with reference to the drawings.

Figure 1:
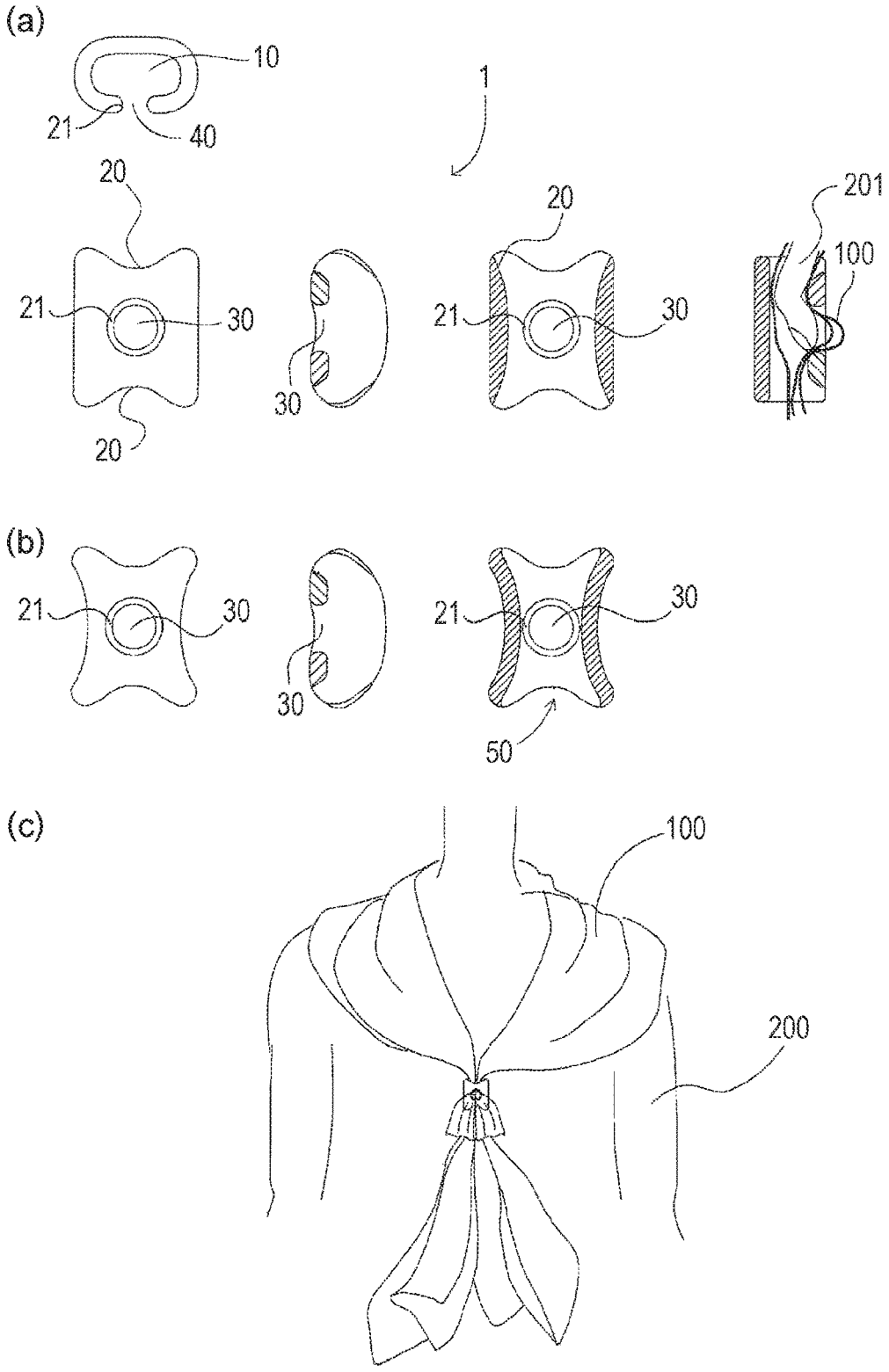
FIG. 1 is a configuration explanatory view illustrating a basic configuration of a fabric fastener of the invention of the present application.

FIG. 1 is an explanatory view illustrating an entire configuration of the fabric fastener 1 of the invention of the present application. FIG. 1(*a*) illustrates a basic configuration of the fabric fastener 1 of the invention of the present application. FIG. 1(*b*) illustrates an example of a narrowed insertion path 100 in a narrowed form on an insertion path 10 according to the invention of the present application. FIG. 1(*c*) illustrates an example where a person 200 uses the fabric fastener 1 of the invention of the present application to wear fabric 100 such as a scarf. In this example, the fabric 100 from both shoulders of the person 200 is inserted into an upper opening portion 20 from the right and left, is drawn out from a lower opening portion 20, and is then further drawn out from a drawing hole 30 provided on a front side. Thus, the fabric 100 is in a decorated form of a ribbon shape extending downward on the front side.

Figure 2:
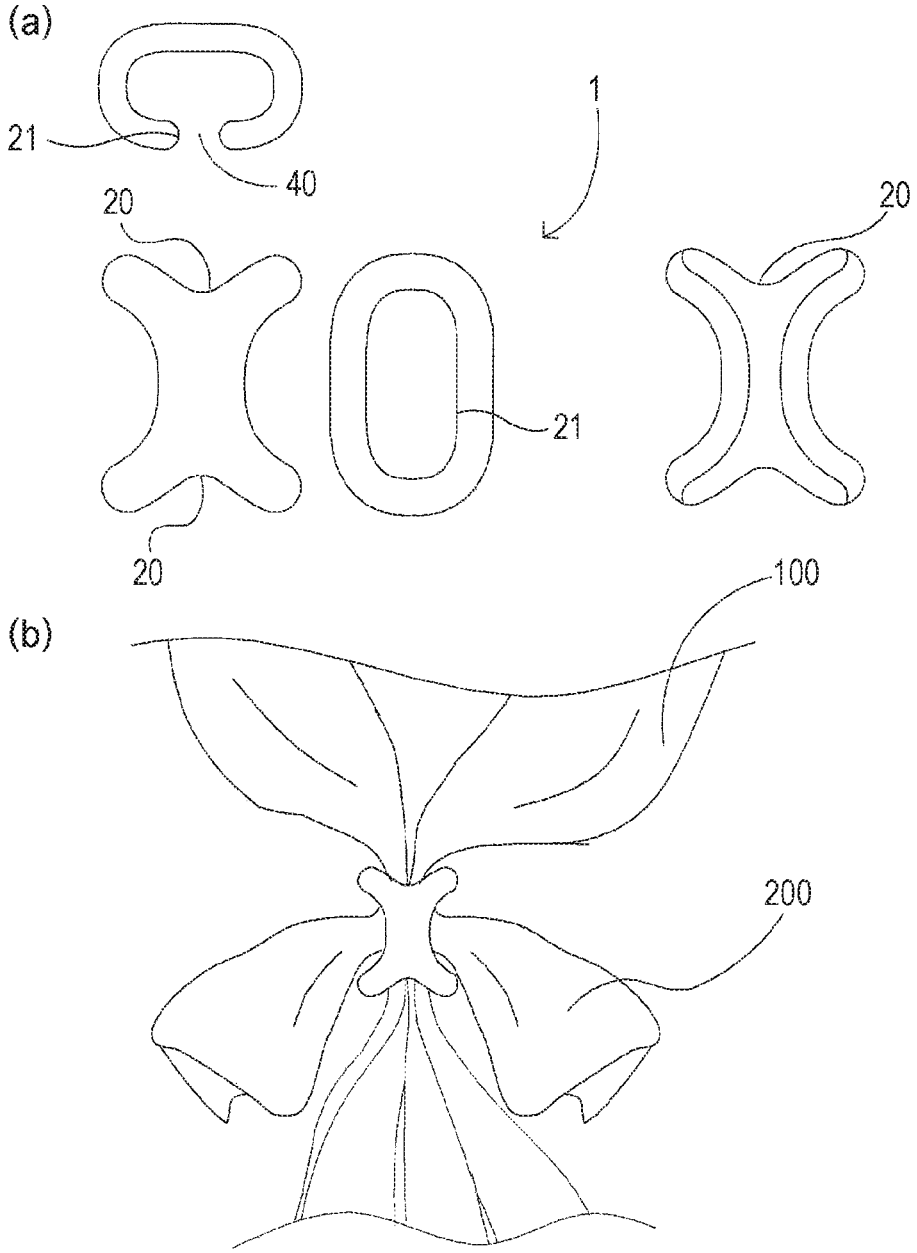
FIG. 2 is a state explanatory view illustrating a state in which a drawing portion is provided at a single position on each side according to the invention of the present application.

FIG. 2 illustrates an example in a case where a single drawing hole 30 is provided at each of right and left side portions of a fabric fastener 1 of the invention of the present application. FIG. 2(*a*) illustrates a basic configuration. FIG. 2(*b*) illustrates the state of dressing a person 200. This figure illustrates the example of dressing the person 200 in the case where the drawing holes 30 are provided respectively on right and left sides. In this example, fabric 100 such as a scarf is downwardly inserted from both shoulders into an upper opening portion 20, and then, is drawn out from a lower opening portion 20. Then, the fabric 100 is drawn from the drawing holes 30 provided respectively at both right and left side portions to the right and left. Thus, a design is created, in which a ribbon-shaped decoration spreads laterally from each side portion.

Figure 3:
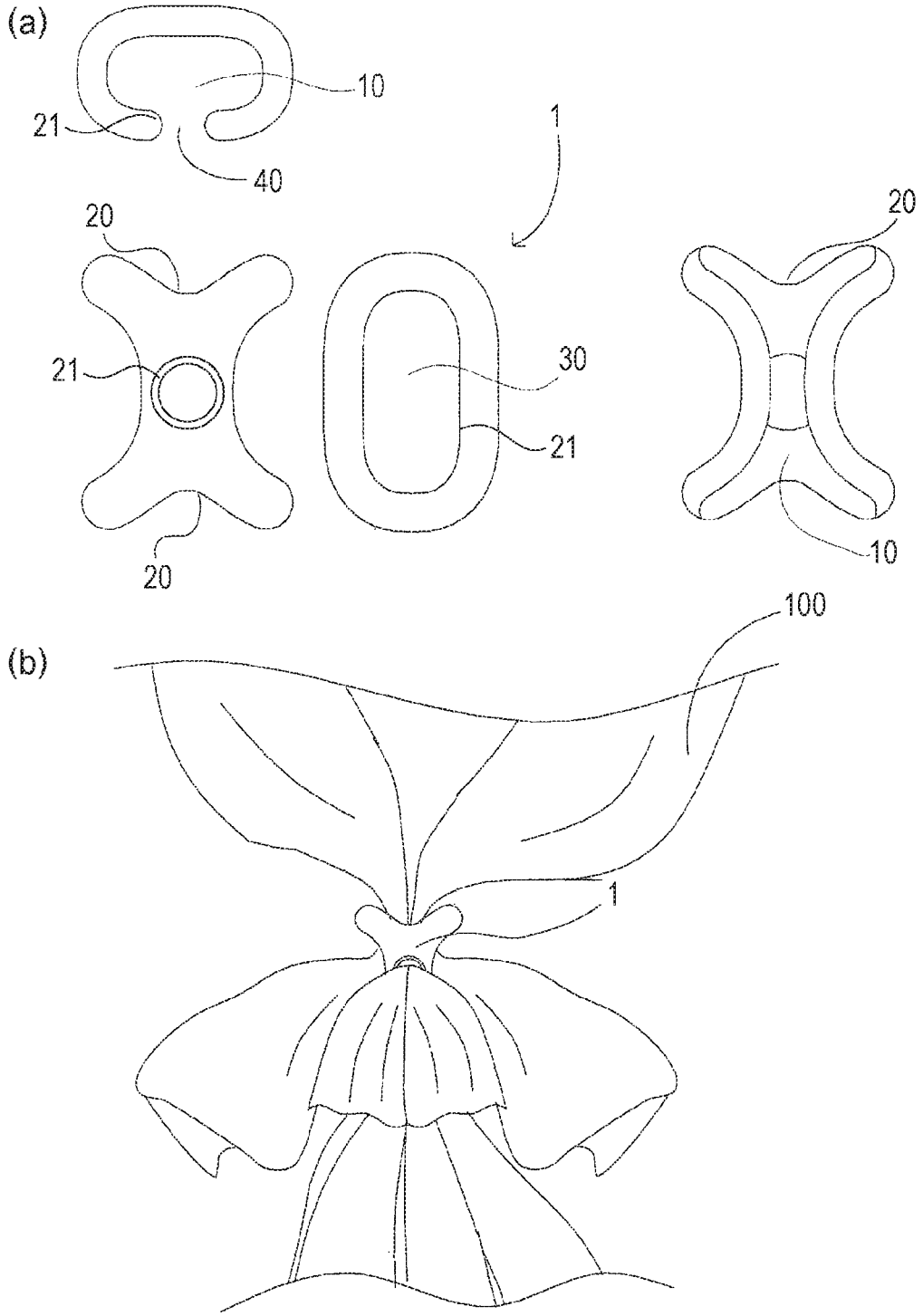
FIG. 3 is a state explanatory view illustrating a state in which a drawing portion is provided at a single position on each side, and is also provided at a single position in a forward direction according to the invention of the present application.

FIG. 3 illustrates an example in a case where a single drawing hole 30 is provided at each of right and left side portions of a fabric fastener 1 of the invention of the present application and another drawing hole 30 is further provided on a front side. FIG. 3(*a*) illustrates a basic configuration. FIG. 3(*b*) illustrates the state of dressing a. person 200. This figure illustrates the example of dressing the person 200 in the case where the drawing holes 30 are provided respectively at both right and left side portions and a front portion. In this example, fabric 100 such as a scarf is downwardly inserted from both shoulders into an upper opening portion 20, and then, is drawn out from a lower opening portion 20. Then, the fabric 100 is drawn from the drawing holes 30 provided respectively at both right and left side portions and the front portion to right and left sides and the front side. Thus, a ribbon-shaped decoration spreads from each drawing hole 30, and also a three-dimensional formation with the fabric drawn out from the front side is created.

Figure 4:
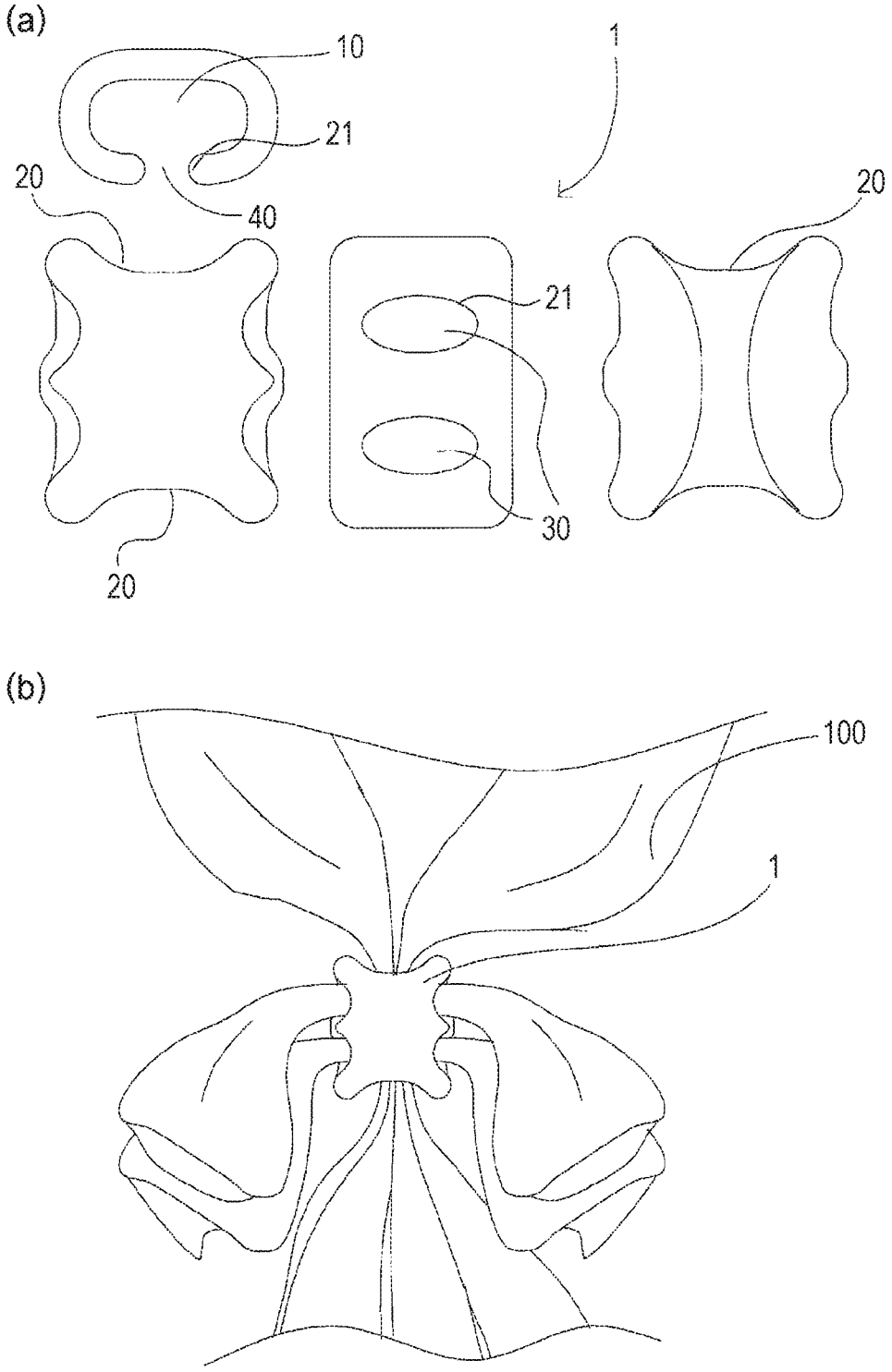
FIG. 4 is a state explanatory view illustrating a state in which drawing portions are provided respectively at two or more positions on each side according to the invention of the present application.

FIG. 4 illustrates an example in a case where two drawing holes 30 are provided at each of right and left side portions of a fabric fastener 1 of the invention of the present application. FIG. 4(*a*) illustrates a basic configuration. FIG. 4(*b*) illustrates the state of dressing a person 200. This figure illustrates the example of dressing the person 200 in the case where the two drawing holes 30 are provided respectively on right and left side portions. In this example, fabric 100 such as a scarf is downwardly inserted from both shoulders into an upper opening portion 20, and then, is drawn out from a lower opening portion 20. Then, the fabric 100 is drawn from the drawing holes 30 provided respectively at both right and left side portions to the right and left. Thus, a three-dimensional design is created, in which a ribbon-shaped decoration spreads from each drawing hole 30.

Figure 5:
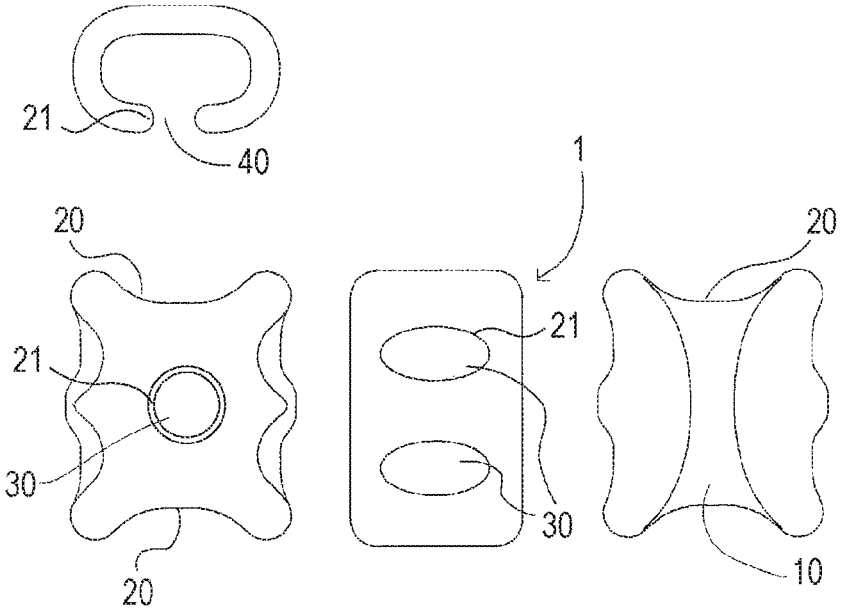
FIG. 5 is a state explanatory view illustrating a state in which drawing portions are provided respectively at two or more positions on each side, and are also provided at one or more positions in the forward direction according to the invention of the present application.
Figure 5:
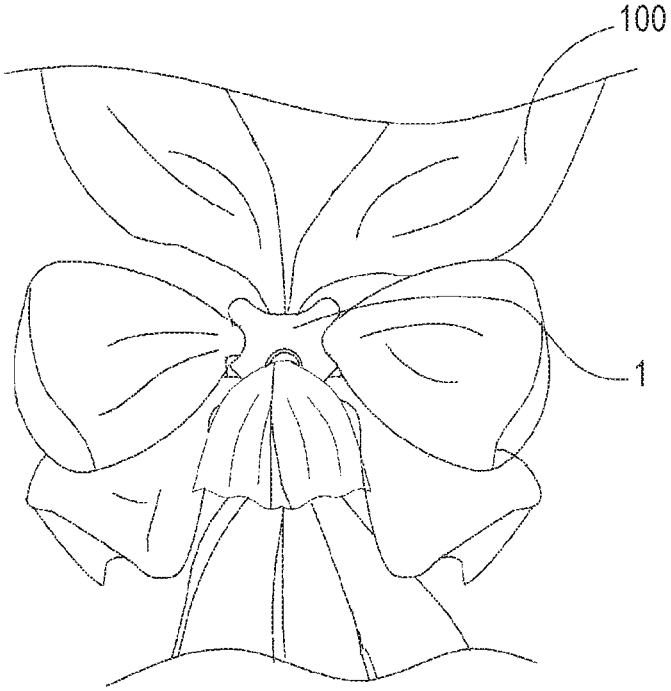

FIG. 5 illustrates an example in a case where two drawing holes 30 are provided at each of right and left side portions of a fabric fastener 1 of the invention of the present application and another drawing hole 30 is further provided on a front side. FIG. 5(*a*) illustrates a basic configuration. FIG. 5(*b*) illustrates the state of dressing a person 200. This figure illustrates the example of dressing the person 200 in the case where the drawing holes 30 are provided respectively at both right and left side portions and a front portion. In this example, fabric 100 such as a scarf is downwardly inserted from both shoulders into an upper opening portion 20, and then, is drawn out from a lower opening portion 20. Then, the fabric 100 is drawn from the drawing holes 30 provided respectively at both right and left side portions and the front portion to right and left sides and the front side. Thus, a ribbon-shaped decoration spreads from each drawing hole 30, and also a three-dimensional formation with the fabric drawn out from the front side is created.

Figure 6:
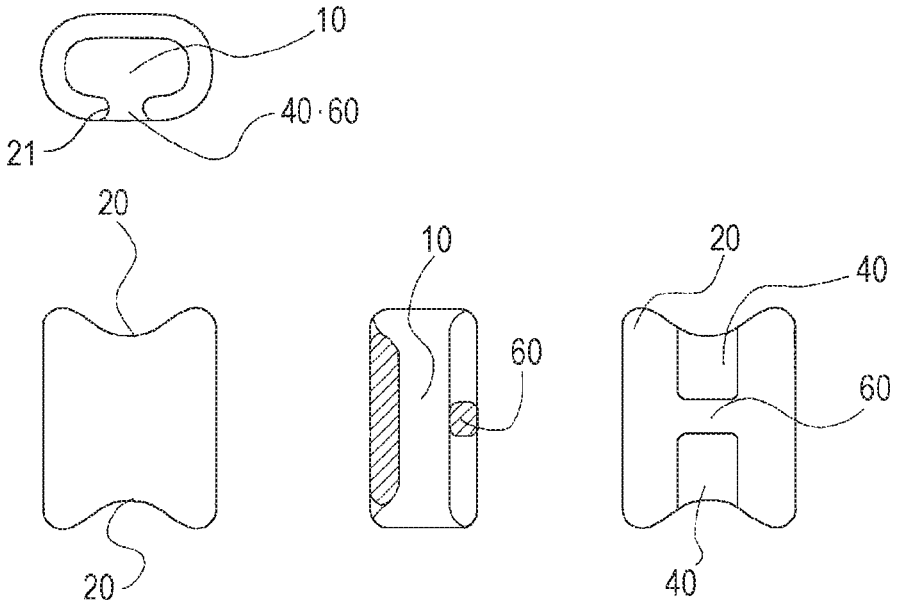
FIG. 6 is a configuration explanatory view describing a narrowed insertion path shape according to the invention of the present application.

FIG. 6 illustrates such a configuration that a bridge 60 is provided at a slit portion 40 of the invention of the present application to limit elastic force of the insertion path 10. In the case of employing such a configuration, the insertion path becomes less expandable. Thus, a looseness reduction effect is exerted.

The entirety of the fabric fastener 1 of the invention of the present application is formed in a substantially tubular shape with the opening portions 20 and the drawing hole(s) 30. For example, a rubber or resin having elastic force is used as a material forming such an entire shape. Note that such a material is not limited to rubber, resin, or the like. Metal may be used as long as the metal has elastic force.

Moreover, the opening portions 20 of the fabric fastener 1 of the invention of the present application are holes positioned on the outermost side of the insertion path 10. Each opening portion 20 is in such a hole shape that the fabric is easily inserted with a finger. Moreover, it is also effective that the opening portion has a configuration with a curved surface extending inward from an end portion. In the case of employing such a configuration, a diameter difference between the vicinity of the inner center and the opening portion leads to a narrowed shape, and therefore, a looseness prevention effect can be further exerted.

Furthermore, the opening portions have substantially V-shaped or U-shaped constrictions provided on an upper and lower sides in order to guide a finger. By employing such a shape, a scarf and the like made of a delicate material such as silk is less damageable. The finger can be guided such that the protruding fabric is easily drawn out from the outside of the drawing hole after the fabric has been tucked as far as the drawing hole with the finger.

INDUSTRIAL APPLICABILITY

The fabric fastener of the invention of the present application can be used as a fastener not only for body decoration fabric such as a scarf, but also for general fabric such as a curtain or a flag. Moreover, when this fastener is used for, e.g., decoration of a tube into which a flower bouquet or an award certificate is placed, an extremely-high aesthetic effect is exerted. Thus, it is expected that many potential customers of the fastener will be found.

LIST OF REFERENCE NUMERALS

1 fabric fastener
10 insertion path
20 opening portion
21 rim portion
30 drawing hole
40 slit portion
50 narrowed insertion path
60 bridge portion
100 fabric
200 person
201 finger

The invention claimed is:

1. A fabric fastener for fastening fabric used as a piece of body decoration equipment, comprising a substantially tubular body having a substantially C-shaped cross section, wherein the substantially tubular body is provided with an insertion path for tucking and fixing the inserted fabric, a slit portion provided at the insertion path, opening portions, and a drawing hole, the opening portions have substantially V-shaped or U-shaped constrictions provided on an upper and lower sides in order to guide a finger, the drawing hole includes at least one hole formed such that the fabric inserted through the opening portion is drawn out in a circumferential direction with respect to an insertion direction, and rim portions of the drawing hole and the opening portions are rounded.

2. The fabric fastener according to claim 1, wherein the drawing hole of the fabric fastener is provided at a single position on each of sides of the substantially tubular body in the circumferential direction.

3. The fabric fastener according to claim 2, wherein the insertion path is in a shape narrowed inward from the opening portions.

4. The fabric fastener according to claim 2, wherein the slit portion is coupled by at least one bridge.

5. The fabric fastener according to claim 1, wherein the drawing hole is provided at a single position on each of sides of the substantially tubular body in the circumferential direction, and is also provided at a single position in a forward direction.

6. The fabric fastener according to claim 5, wherein the insertion path is in a shape narrowed inward from the opening portions.

7. The fabric fastener according to claim 5, wherein the slit portion is coupled by at least one bridge.

8. The fabric fastener according to claim 1, wherein the drawing hole of the fabric fastener is provided at two or more positions on each of sides of the substantially tubular body in the circumferential direction.

9. The fabric fastener according to claim 8, wherein the insertion path is in a shape narrowed inward from the opening portions.

10. The fabric fastener according to claim 8, wherein the slit portion is coupled by at least one bridge.

11. The fabric fastener according to claim 1, wherein the drawing hole of the fabric fastener is provided at two or more positions on each of sides of the substantially tubular body in the circumferential direction, and is also provided at one or more positions in a forward direction.

12. The fabric fastener according to claim 11, wherein the insertion path is in a shape narrowed inward from the opening portions.

13. The fabric fastener according to claim 11, wherein the slit portion is coupled by at least one bridge.

14. The fabric fastener according to claim 1, wherein the insertion path is in a shape narrowed inward from the opening portion.

15. The fabric fastener according to claim 14, wherein the slit portion is coupled by at least one bridge.

16. The fabric fastener according to claim 1, wherein the slit portion has at least one linking bridge.

* * * * *